US005377660A

United States Patent [19]

Bombardier

[11] Patent Number: 5,377,660

[45] Date of Patent: Jan. 3, 1995

[54] PROTECTIVE COVER

[76] Inventor: Claudine Bombardier, 201 Bas Riviere Nord, St. Cesaire, Quebec

[21] Appl. No.: 53,223

[22] Filed: Apr. 28, 1993

[30] Foreign Application Priority Data

Apr. 30, 1992 [CA] Canada ..... 2,067,702

[51] Int. Cl.[6] ..... F24C 3/12

[52] U.S. Cl. ..... 126/42; 126/37 A; 126/37 B

[58] Field of Search ..... 126/42, 37 A, 37 B

[56] References Cited

U.S. PATENT DOCUMENTS 1,784,764 12/1930 Stockstrom et al. ..... 126/37 A
2,390,234 12/1945 Applebaum ..... 126/42
2,539,840 1/1951 Jones ..... 126/42 X
2,556,444 6/1951 Reeves ..... 126/37 R X
2,764,968 10/1956 Shuster ..... 126/42
4,836,181 6/1989 Saga ..... 126/42
4,867,135 9/1989 Stecker ..... 126/500
5,233,969 8/1993 Koledin ..... 126/9 B X

*Primary Examiner*—Larry Jones
*Attorney, Agent, or Firm*—Eric Fincham

[57] ABSTRACT

The invention provides a protector cover suitable for the head of a stove which contains the controls and typically a glass panel, the protective cover being formed of a flexible substantially non-flamable material with a front panel, a rear panel, a top panel between the front and rear panels, a pair of opposed side panels, and with the front panel being moveable upwardly to permit access to controls on the front of the stove head. The cover is designed to protect the front of the stove during cooking operations with the front panel being moveable to provide access to the controls.

9 Claims, 2 Drawing Sheets

PROTECTIVE COVER

BACKGROUND OF THE INVENTION

The present invention relates to a cover and more particularly, relates to a cover suitable for the head of a stove.

Many stoves and/or ranges of either a gas or electrical type have a somewhat conventional configuration in that there is provided a flat portion containing the cooking elements and below which is situated the oven. A head portion extends upwardly from the back of the cooking elements and usually contains the controls thereon. Although other arrangements are also utilized in the art, the above mentioned is a conventional one and it is to this particular structure that the present invention is directed.

When it comes to cleaning stoves and ranges, the head portion at the back frequently presents a problem. In a conventional arrangement, these stoves contain a glass panel to provide visual access to markings for time and/or temperature. Due to the nature of the structure, apertures must be provided in the glass for control knobs and after a period of time, vapors which are usually present during the cooking process can get behind the glass and deposit on a surface. This presents a difficult cleaning task since the glass and associated components are not designed for easy removal since they must be secure in order to minimize such vapours entering behind the glass. Accordingly, it becomes a major time consuming task to clean the glass and associated components.

SUMMARY OF THE INVENTION

It is an object of the present invention to provide a protective cover for the head of the stove to substantially minimize the entry of vapours there behind.

According to the present invention, there is provided a protective cover suitable for the head of a stove, the cover being formed of a flexible substantially non-flamable material, the cover comprising a rear panel, a front panel, a top panel intermediate the front and rear panels, and a pair of opposed side panels, the front panel being moveable upwardly to permit access to controls on the front of the stove head.

In greater detail, the protective cover of the present invention can be formed of many different suitable material known to those knowledgeable in the art. Preferably, it is formed of a flexible material which will permit the folding and easy cleaning of the same. The cover must also be of a relatively non-flamable material and again, there are many such materials known in the art. The material may be selected from those which are inherently non-flamable or alternatively the material may be treated to impart the desired non-flamable properties. Preferably, the material will also provide the desirable esthetic properties and would remain cool to the touch even with its proximity to the heating elements of the stove and the natural environment. It is also desirable that the interior surface of the cover be of a protective nature so as not to scratch or otherwise mark any of the surfaces of the head of the stove. To this end, one may utilize different materials in the form of laminates to provide the desired properties on the interior and exterior of the cover. In one particularly desirable embodiment, the interior surface is made of a cloth like material while the exterior surface is formed of a reflective material to reflect any heat therefrom.

In the preferred embodiment, the cover member comprises sheet material which is formed into the desired configuration to cover the front, top and sides of the stove head. Although one could utilize separate panels suitably secured together, one preferred embodiment uses a single sheet of material which forms the front, top and rear panels with side panels being secured thereto by sewing. Alternatively, a single piece of material either sewn in a gusseted fashion or having cutouts and suitably sewn may be employed.

The front panel is designed to be moveable upwardly and to this end, the front panel is preferably not secured to the side panels in a permanent fashion, but rather is detachably secured thereto. Although many different types of fasteners may be employed, a particularly convenient mode would be the use of releasable hook and eye type of fasteners, one brand of which is marketed under the trade mark "VELCRO".

BRIEF DESCRIPTION OF THE DRAWINGS

Having thus generally described the invention, reference will be made to the accompanying drawings illustrating an embodiment thereof, in which.

DETAILED DESCRIPTION OF THE PREFERRED EMBODIMENT

Figure 1:
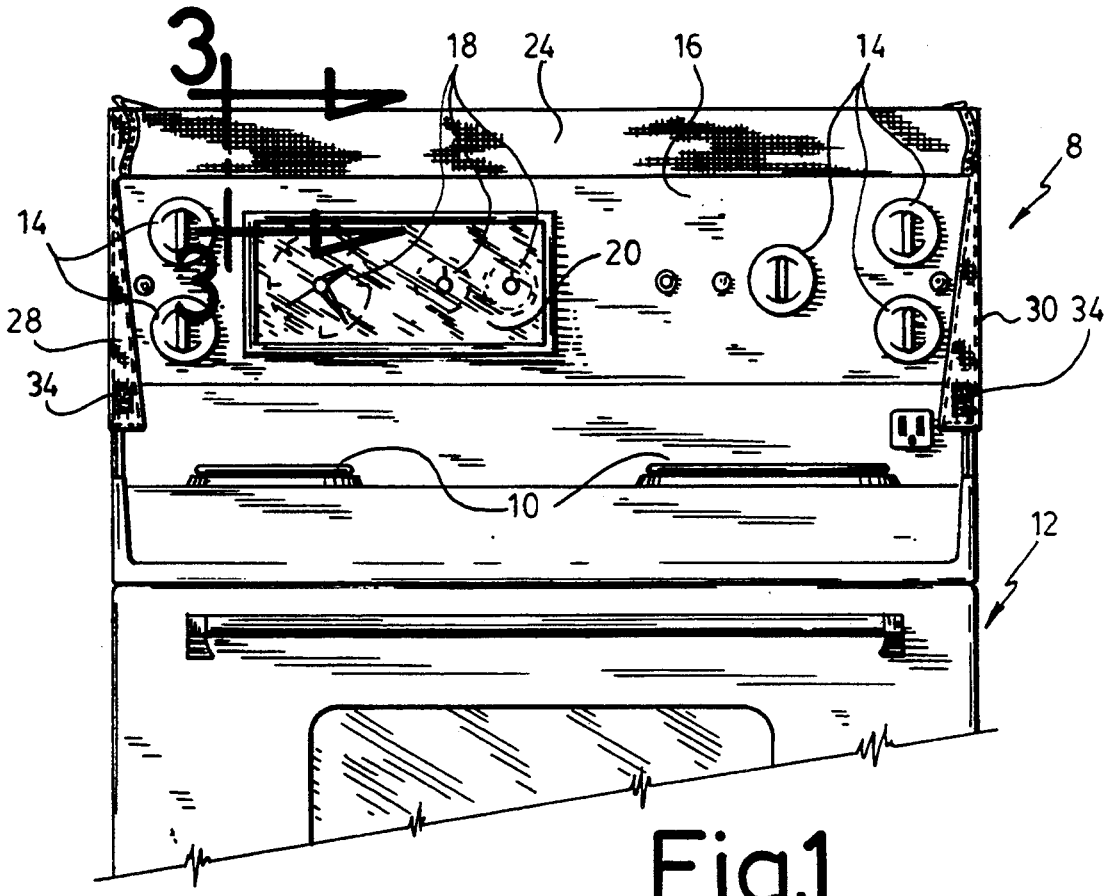
FIG. 1 is a front elevational view showing a portion of a stove and the cover member in a position to permit access to the stove controls.

Referring to the drawings in greater detail and by reference characters thereto, there is shown a stove which has a oven portion generally designated by reference numeral 12 with heating elements 10 on an upper surface thereof and a head portion generally designated by reference numeral 8 extending upwardly from the rear portion of the stove. On a front surface 26 of head portion 8 there is provided a plurality of controls 14, which controls are typically to regulate the temperature of the elements 10 and the oven portion. Controls 18 are associated with a clock/timer which sits behind a glass panel 20. The above arrangement is a conventional one for a free standing stove.

A hood or cover 21 is provided and which cover includes a back panel 22, a front panel 24, a top panel 26 extending between front and back panels 24 and 22 respectively, and a pair of side panels 28 and 30.

Figure 2:
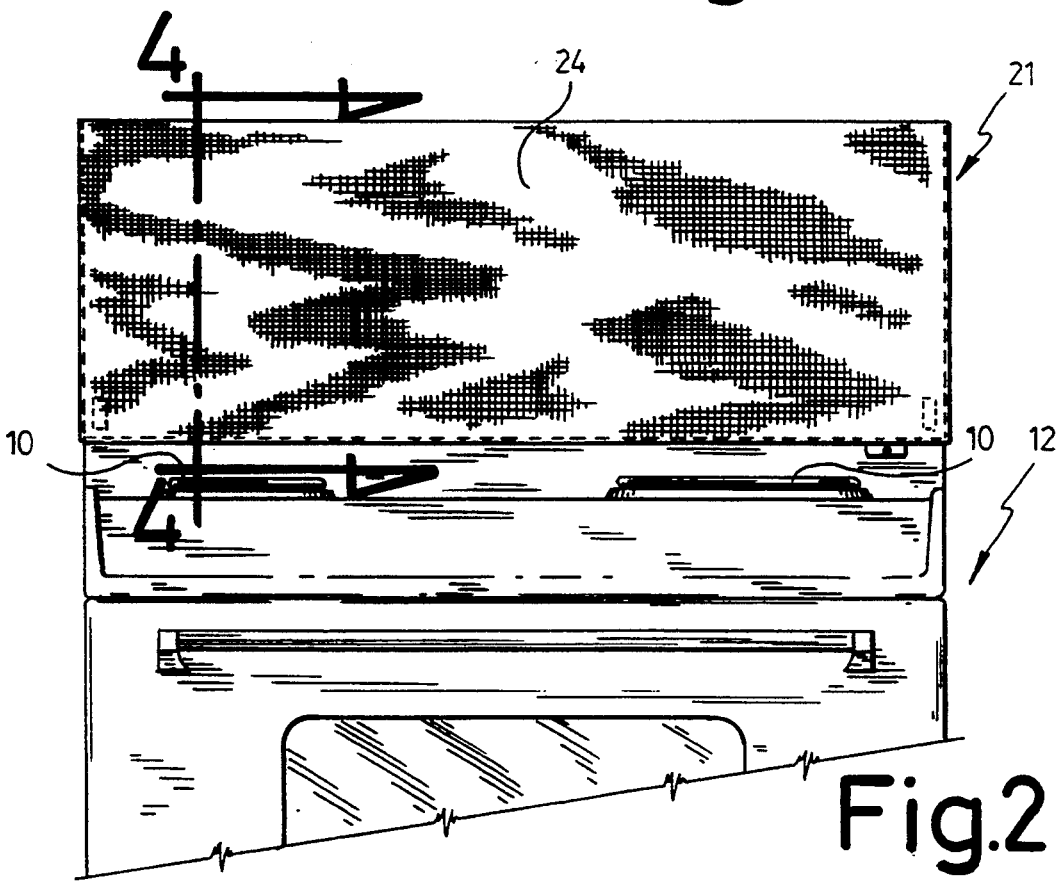
FIG. 2 is a view similar to FIG. 1 showing the cover in its position during normal cooking.
Figure 3:
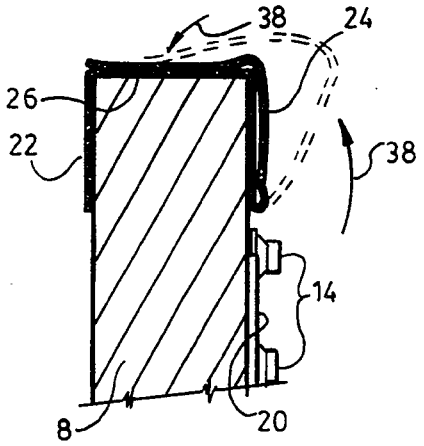
FIG. 3 is a sectional view taken along the lines 3—3 of FIG. 1.
Figure 4:
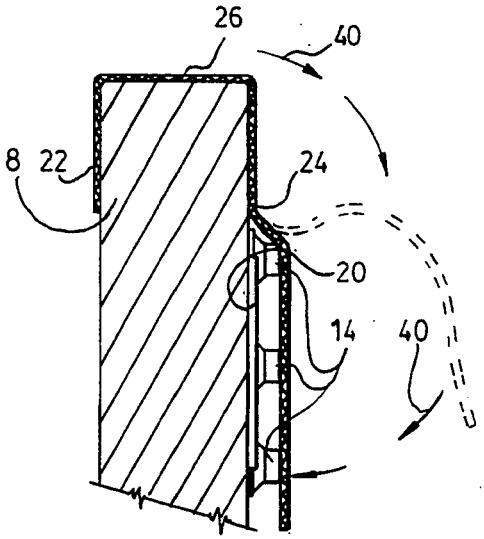
FIG. 4 is a sectional view taken along the lines 4—4 of FIG. 2.
Figure 5:
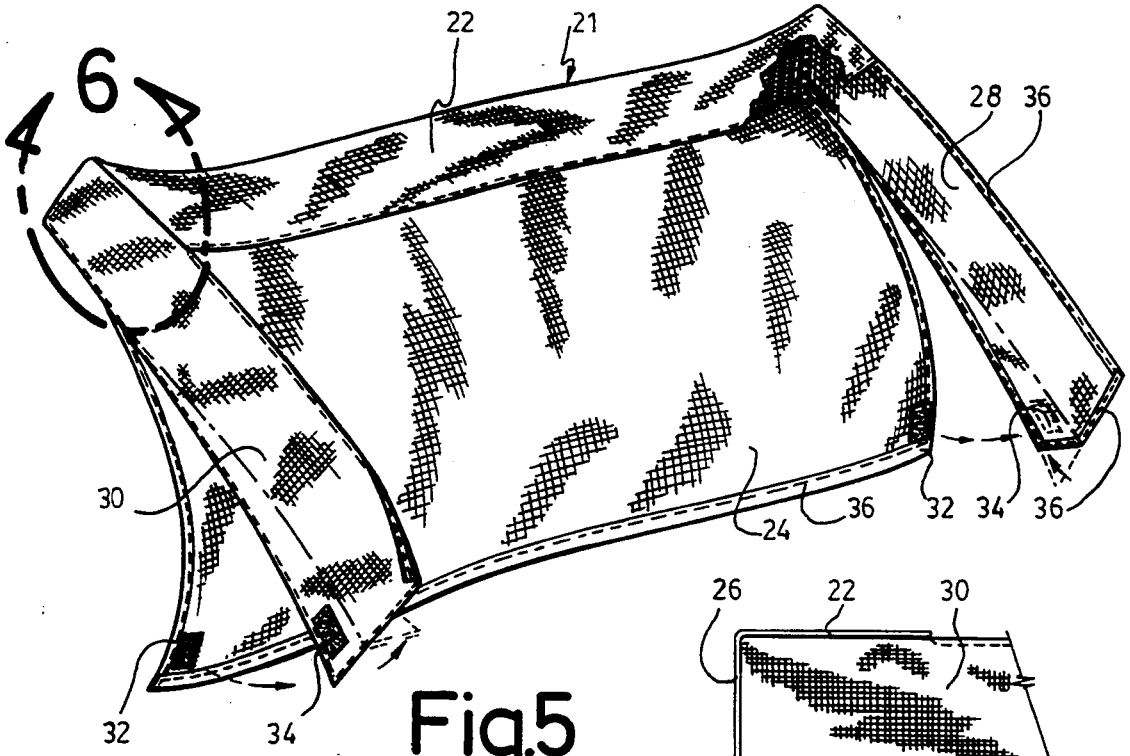
FIG. 5 is a perspective view of the cover member.
Figure 6:
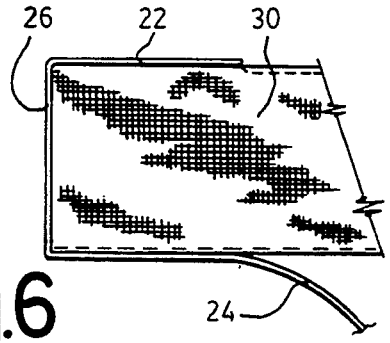
FIG. 6 is a detailed view as indicated by arrow 6 of FIG. 5.

As shown in FIGS. 1 to 4, front panel 24 may be lowered to a position whereby it substantially covers the front surface 16 of head portion 8. When access is required to the controls, front panel 24 may be lifted and draped on the top and/or rearwardly as indicated by arrows 38 in FIG. 3. When protection is required, front panel 24 may be moved downwardly as indicated by arrows 40 to a protective position.

Cover 21, as may be seen from the drawings, is formed such that a single piece forms back panel 22, front panel 24 and top panel 26. Side panels 28 and 30 are sewn to the other panels. In this respect, it will be noted that side panels 28 and 30 each have one component 34 of a two piece fastening system with the other component 32 being attached to the rearwardly facing surface of front panel Preferably, the fastening system is that of the hook and eye type such as marketed under the trademark "VELCRO". Thus, as may be seen from FIG. 1, side or end panels 28 and 30 are sized such that a portion will extend about the front of the head 8 so that fastening components 34 face frontwardly and permit the attachment of front panel 24 thereto. This provides a secure fastening to minimize entry of vapors.

As shown in the drawings, the free marginal edges may be sewn or hemmed as designated by reference numeral 36.

It will be understood that the above described embodiments are for purposes of illustration only and that changes and modifications may be made thereto without departing from the spirit and scope of the invention.

I claim:

1. A cover member suitable for use with the head of a stove, the cover member comprising a rear panel, a front panel, a top panel intermediate said front and rear panels, and a pair of side panels, said front panel being moveable upwardly into and out of covering relationship with a front surface of the stove head, said cover member being formed of a flexible fire retardant material.

2. The cover of claim 1 wherein said side panels are secured to said rear and top panels and detachable secured to said front panel to permit the upward movement thereof.

3. The cover member of claim 1 wherein said rear panel, top panel and front panel are formed of a single piece of material.

4. The panel of claim 2 wherein said side panels are sewed to said top and rear panel.

5. The panel of claim 2 wherein said front panel is detachably secured to said side panels by fasteners of the flexible hook and eye type.

6. The cover of claim 1 wherein said cover member has an exteriorly facing surface of a heat reflective material.

7. The cover of claim 1 wherein said material is substantially impervious to vapour.

8. The cover member of claim 1 further including at least one transparent area in said front panel portion.

9. A cover for use in conjunction with a stove having a stove head associated therewith, said cover comprising a rear panel, a front panel, a top panel intermediate said front and rear panels, and a pair of side panels, said front panel being moveable inwardly and out of a covering relationship with a front surface of the stove head, said side panels being fixedly secured to said rear and top panels, said side panels being detachably secured to said front panel to permit upward movement thereof, said cover member being formed of a flexible fire retardant material.

* * * * *